US011499385B2

(12) United States Patent
Doane et al.

(10) Patent No.: US 11,499,385 B2
(45) Date of Patent: Nov. 15, 2022

(54) RELEASABLE LOCKING ASSEMBLY, SYSTEM, AND METHOD

(71) Applicants: James Doane, Friendswood, TX (US); Christopher Young, Houston, TX (US); Gary Anderson, Dublin, OH (US); David Ruddock, Pearland, TX (US)

(72) Inventors: James Doane, Friendswood, TX (US); Christopher Young, Houston, TX (US); Gary Anderson, Dublin, OH (US); David Ruddock, Pearland, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/162,397

(22) Filed: Jan. 29, 2021

(65) Prior Publication Data

US 2022/0243546 A1 Aug. 4, 2022

(51) Int. Cl.

| | |
|---|---|
| ***E21B 23/02*** | (2006.01) |
| ***E21B 23/10*** | (2006.01) |
| ***E21B 33/12*** | (2006.01) |

(52) U.S. Cl.

CPC ..... *E21B 23/02* (2013.01); *E21B 23/10* (2013.01); *E21B 33/12* (2013.01)

(58) Field of Classification Search

CPC ..... E21B 23/02; E21B 23/10; E21B 33/12

See application file for complete search history.

(56) References Cited

U.S. PATENT DOCUMENTS

| | | | | |
|---|---|---|---|---|
| 3,474,857 | A * | 10/1969 | Newman | E21B 33/037 166/368 |
| 3,871,456 | A * | 3/1975 | Sizer | E21B 34/14 166/298 |
| 4,407,362 | A * | 10/1983 | Bechthold | E21B 43/123 166/117.5 |
| 4,614,233 | A * | 9/1986 | Menard | E21B 47/092 166/240 |

* cited by examiner

*Primary Examiner* — Jonathan Malikasim

(74) *Attorney, Agent, or Firm* — Cantor Colburn LLP

(57) ABSTRACT

A releasable locking assembly including a housing, a body defining a longitudinally extending flow bore having a first end and a second end disposed within the housing, a window defined through a radial wall of the body, a locking segment having an outer convex surface of a first radius defined by distance from a first axis, and an inner concave surface of a second radius defined by distance from a second axis different than the first axis, the locking segment disposed at least in part in the window, and a support member disposed within the body and moveable between a position where the support member drives the locking segment into engagement with the housing and a position where the support member unsupports the locking segment with regard to engagement with the housing.

20 Claims, 7 Drawing Sheets

RELEASABLE LOCKING ASSEMBLY, SYSTEM, AND METHOD

BACKGROUND

In the resource recovery industry, there are often needs to position tools in a fixed manner for some period of time and then allow movement of those tools at another period of time. Often such requires can present difficulties related to the means by which a change in the tool is functioning requires input that may also have effect on other tools at a time when that affect is undesirable. Accordingly, the art is always receptive to configurations that avoid such problems and enhance operability and efficiency of wellbore systems.

SUMMARY

An embodiment of a releasable locking assembly including a housing, a body defining a longitudinally extending flow bore having a first end and a second end disposed within the housing, a window defined through a radial wall of the body, a locking segment having an outer convex surface of a first radius defined by distance from a first axis, and an inner concave surface of a second radius defined by distance from a second axis different than the first axis, the locking segment disposed at least in part in the window, and a support member disposed within the body and moveable between a position where the support member drives the locking segment into engagement with the housing and a position where the support member unsupports the locking segment with regard to engagement with the housing.

An embodiment of a multiple flow bore body comprising a locking assembly for the body actuated from one of the multiple flow bores.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
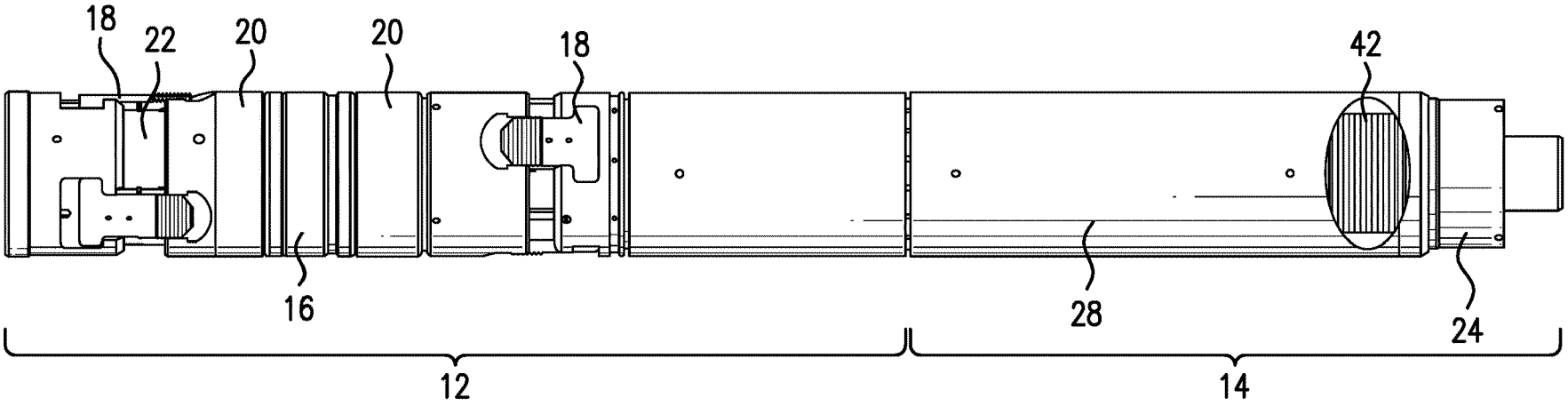
FIG. 1 is a side view of a downhole tool having a releasable locking assembly as disclosed herein.
Figure 2:
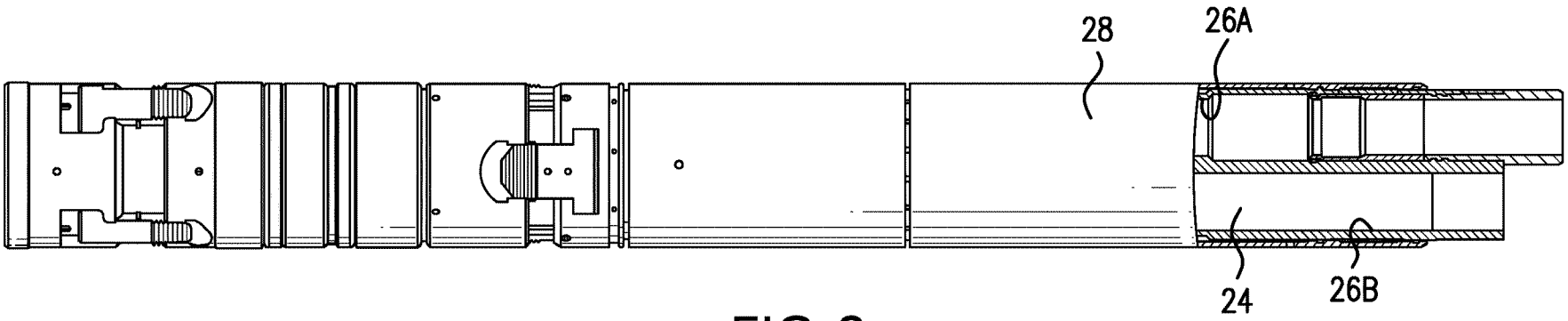
FIG. 2 is the view of FIG. 1 rotated 90 degrees and with a portion cut away.
Figure 3:
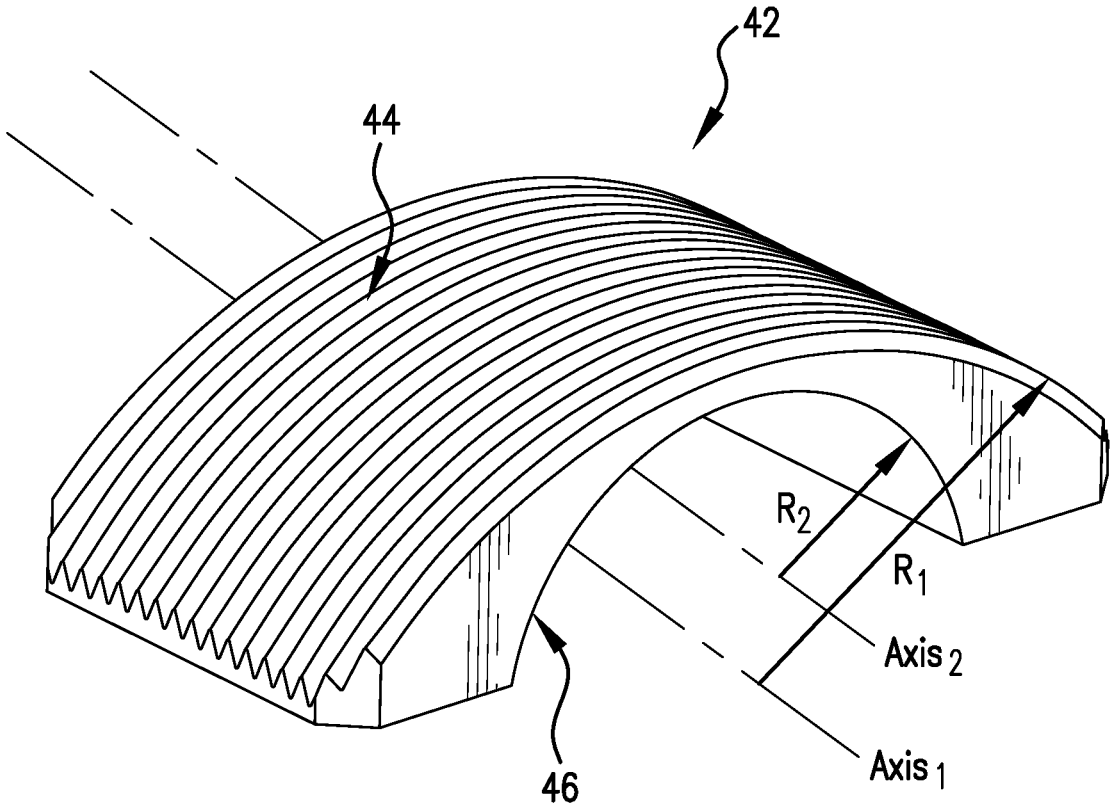
FIG. 3 is a perspective view of the locking segment as disclosed herein.
Figure 4:
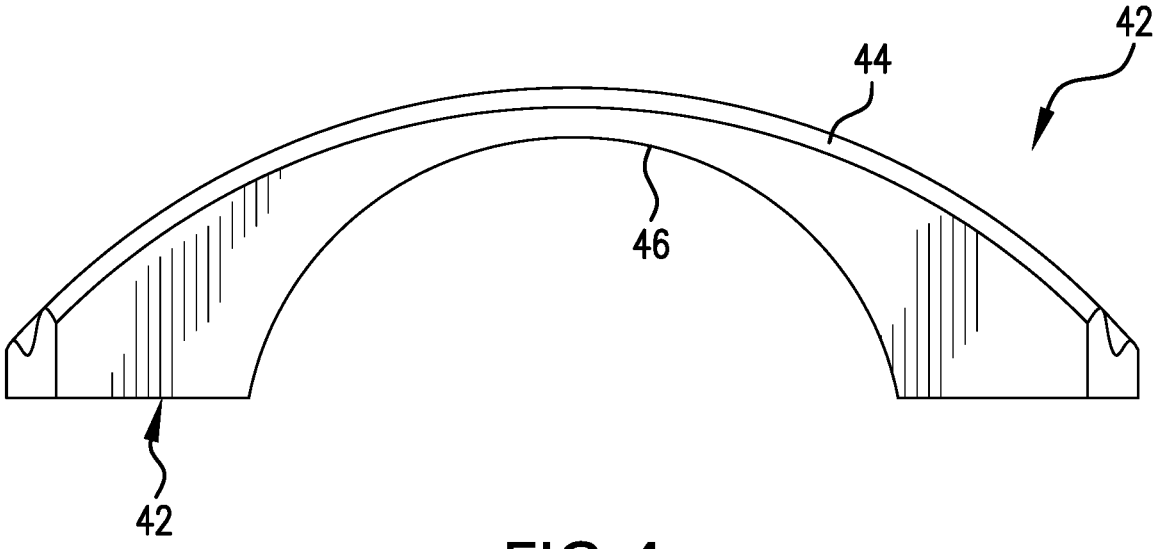
FIG. 4 is an end view of the locking segment illustrated in FIG. 3.
Figure 5:
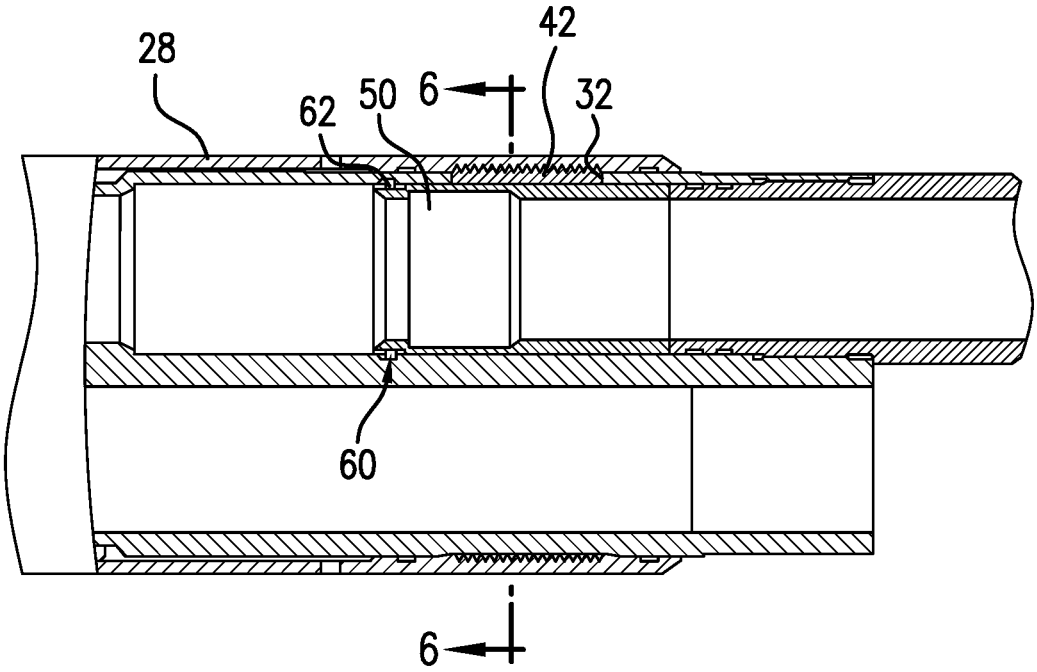
FIG. 5 is an expanded view of the cutaway section of FIG. 2.

Referring to FIG. 1, a downhole seal tool 10 is illustrated. It should be appreciated that while this tool is illustrated as a seal tool, the operative portions of the locking assembly employed in this tool 10 may also be employed with other tools without departing from the full scope of the disclosure herein. Tool 10 includes a seal assembly 12 and a releasable locking assembly 14. Simply for context, the seal assembly 12 includes an element 16, slips 18 and cones 20. The seal assembly in some embodiments is a packer and in a particular embodiment is a solid body packer, meaning that a mandrel 22 upon which the seal components are disposed is a single unitary piece of material, which in the case of a multiple flow bore arrangement, will have more than one individual flow bores that are formed within the single piece unitary piece of material. The flow bores may be formed for, example, by drilling, milling, or through an additive manufacture process. The tool 10 is settable in the downhole environment and then the releasable locking assembly 14 is unlockable such that the seal assembly 12 and hence the tool 10, may be retrieved by tensile load placed thereon. The tensile load is placed upon a body (described hereunder) that cannot move relative to a housing until the locking assembly 14 is unlocked, that relative movement being required in order to retrieve the tool 10 via tensile load. With the releasable locking assembly 14 in the locked position, tensile load may be applied as desired, for any reason, without undermining the set condition of the seal assembly 12 (e.g. without disengaging the assembly 12 from the casing, not shown but will be understood to be radially outward of the tool 10). This provides many benefits to the art, particularly in multiple flow bore configurations, in the form of allowing operations previously not possible without undermining the set condition of the seal assembly 12.

Referring to FIGS. 2 through 8, the locking assembly 14 and its components are illustrated in various views and in both locked and unlocked conditions. Locking assembly 14 includes a body 24 having at least two flow bores 26A, 26B that are formed in a single unitary piece of material, in an embodiment. The flow bores 26 may be formed for, example, by drilling, milling, or through an additive manufacture process. The body 24 is disposed within a housing 28. The housing in some embodiments will include an internal lock segment engagement feature 30 (best visible in FIG. 7). The feature 30 may be a ti'-groove in some cases. The body 24 defines a window 32 through a radial wall of the body 24. One will note that the window 32 only intersects one of the multiple flow bores 26. In other embodiments, more windows 32 may be present but in each of those cases, those windows will only intersect a single flow bore 26. Each window 32 is defined in part by predominantly a chord 34 across one of the flow bores 26 (identified with a broken line in FIG. 8), that chord 34 not intersecting a longitudinal axis of the respective flow bore 26 and having upsets 38 at each end of the chord 34. The window 32 is further defined in part by an outside diameter surface 40 of body 24.

At least artially disposed within the window 32 is a locking segment 42. It is to be appreciated that the locking segment 42 includes an outer convex surface 44 of a first radius $R_1$ defined by distance from a first axis $Axis_1$, and an inner concave surface 46 of a second radius $R_2$ defined by distance from a second axis $Axis_2$ different than the first axis $Axis_1$. The outer convex surface 44 presents a much larger area for engagement with the housing 28 than would a segment that would traditionally be formed to have an outside surface that is concentric with the inside surface. Where multiple flow bores are being used as in the presently described tool 10 or similar thereto, the traditional concentric type of configuration would provide significantly less area for engagement with the housing 28. Therefore, with the configuration as described herein, where outer and inner surfaces present different radiuses on different axes, a significantly greater load rating capability is achieved.

Figure 6:
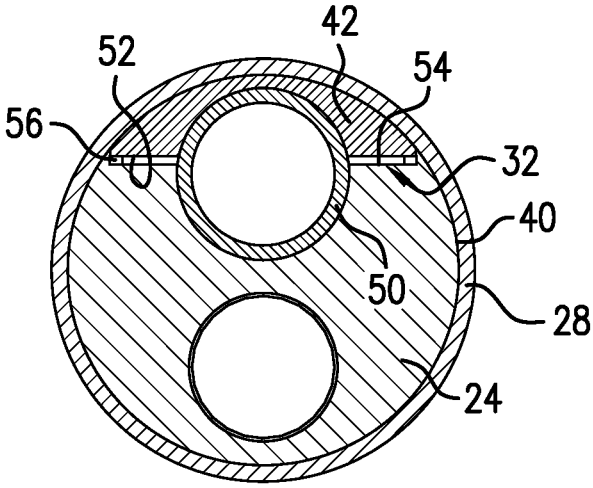
FIG. 6 is a cross sectional view of FIG. 5 taken along section line 6-6.
Figure 7:
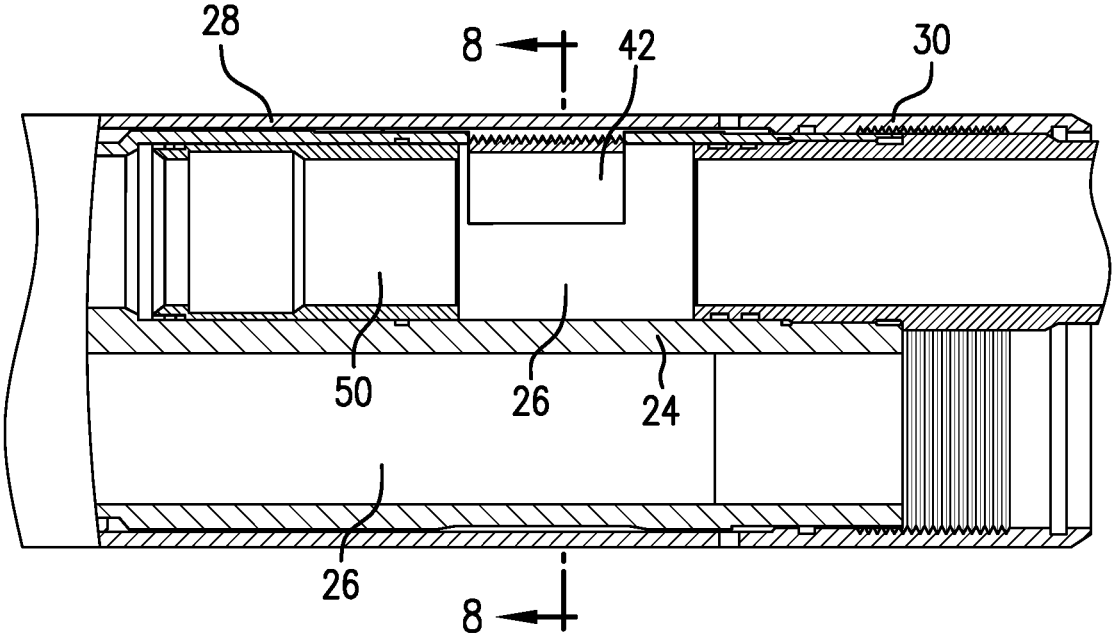
FIG. 7 is the view of FIG. 5 but shifted to an unlocked position.
Figure 8:
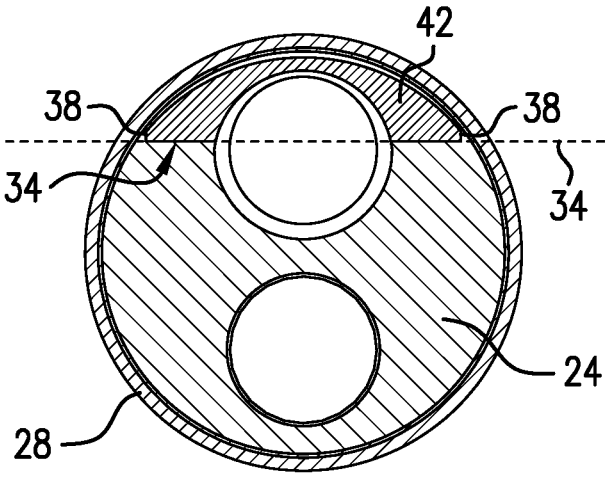
FIG. 8 is a cross section view of FIG. 7 taken along section line 8-8.

In some embodiments, the locking segment 42 will have a surface treatment on surface 44. The treatment is to increase engagement with the housing 28. In some embodiments the surface treatment will be complementary to the housing 28 where engagement is to occur and in some embodiments the surface treatment will present a V-groove pattern. Importantly, it is noted that the dimensions of the locking segment 42 will be slightly less than the dimensions of the window 32 in order to allow operation of the locking segment in response to support movement. This can best be appreciated by comparing the positions of the locking segment 42 in FIGS. 6 and 8. In FIG. 6 the locking segment is supported by a support member 50, which may be in the form of a sleeve and is slidingly disposed in a flow bore 26. It will be appreciated that a resting surface 52 of locking segment 42 is in a different location than a window ledge 54 of the body 24. A space 56 is created as illustrated. Conversely in FIG. 8, the space 56 is gone such that surface 52 and ledge 54 are coextensive. This configuration provides for room for the locking segment 42 to disengage from the housing 28 and also be stored in that position resting against the ledge 54. The movement of the support member 50 that allows for the unsupporting and hence unlocking of the locking segment 42 can best be appreciated by comparing FIGS. 5 and 7. The support member 50 may be shiftable mechanically or by other appropriate means. The sleeve 50 in one embodiment includes a release configuration 60 interactive with the body 24 until a predetermined threshold force is applied to the sleeve 50 thereby releasing the release configuration 60. In an embodiment, release configuration 60 may comprise shear members 62.

As noted above, the locking assembly 14 may be used with operational components other than seal assembly 12 that would benefit from allowing tensile loads without disengaging the tool until the locking assembly 14 is shifted and unlocked.

Figure 9:
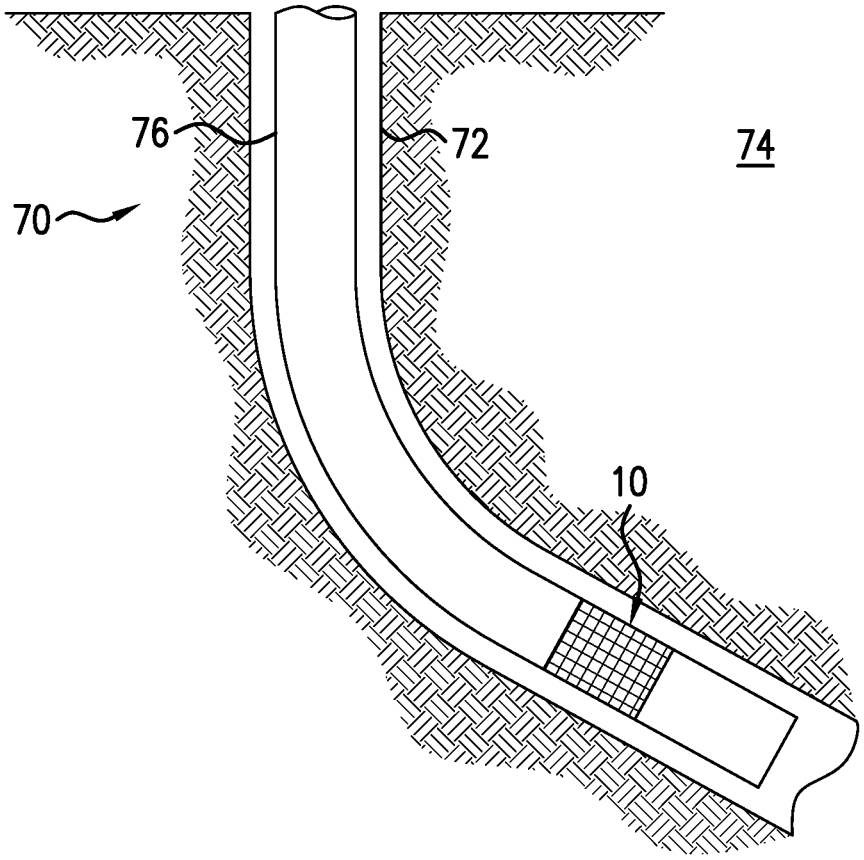
FIG. 9 is a schematic system drawing.

Further disclosed herein, referring to FIG. 9, is a wellbore system 70 that includes a borehole 72 in a formation 74. A string 76 is disposed in the borehole 72 and a releasable locking assembly 14 as described above form a part of a tool 10 disposed in the string 76.

In use, the tool 10 is run into borehole and set as normal. The releasable locking assembly 14 is pre locked prior to running. The locking may happen at a manufacturing facility or could be competed on a rig. After setting of the seal assembly 12 (or other tool), operations are carried out in the borehole 72. When it is desired to release the seal assembly 12, a wireline, slick line, coiled tube, etc, it run into a flow bore 26 that has a window 32. A separate run is necessary for each flow bore 26 (A, B, etc.) in which a window 32 and a locking segment 42 are located. The support member 50 is shifted to a position where it no longer supports the locking segment 42 in engagement with the housing 28. At that point, the locking segment 42 is free to move out of engagement with the housing 28 and may do so based upon gravity or based upon the imminent use of tensile load to unset the seal assembly 12 applied to the body 24. In some embodiments, the \T-groove will be a 60 degree groove to help push the locking segment 42 radially inwardly and out of engagement with the housing 28.

Set forth below are some embodiments of the foregoing disclosure:

Embodiment 1: A releasable locking assembly including a housing, a body defining a longitudinally extending flow bore having a first end and a second end disposed within the housing, a window defined through a radial wall of the body, a locking segment having an outer convex surface of a first radius defined by distance from a first axis, and an inner concave surface of a second radius defined by distance from a second axis different than the first axis, the locking segment disposed at least in part in the window, and a support member disposed within the body and moveable between a position where the support member drives the locking segment into engagement with the housing and a position where the support member unsupports the locking segment with regard to engagement with the housing.

Embodiment 2: The releasable locking assembly as in any prior embodiment, wherein the body defines a plurality of longitudinally extending flow bores therein.

Embodiment 3: The releasable locking assembly as in any prior embodiment, wherein the body is a single piece of material with a plurality of longitudinally extending flow bores formed therein.

Embodiment 4: The releasable locking assembly as in any prior embodiment, wherein the window includes a window ledge that reduces open dimensions of the window to less than external dimensions of the locking segment.

Embodiment 5: The releasable locking assembly as in any prior embodiment, wherein the window is defined in part by a chord through a curvature of the body.

Embodiment 6: The releasable locking assembly as in any prior embodiment, wherein the locking segment includes engagement enhancing features on the convex surface.

Embodiment 7: The releasable locking assembly as in any prior embodiment, wherein the features are V-grooves.

Embodiment 8: The releasable locking assembly as in any prior embodiment, wherein the support member is a sleeve.

Embodiment 9: The releasable locking assembly as in any prior embodiment, wherein the sleeve is shiftable upon release of a sleeve release member releasing.

Embodiment 10: The releasable locking assembly as in any prior embodiment, wherein the sleeve release member is a shear member.

Embodiment 11: A multiple flow bore body comprising a locking assembly for the body actuated from one of the multiple flow bores.

Embodiment 12: The multiple flow bore body as in any prior embodiment, further comprising a second locking assembly actuated from another of the multiple flow bores.

Embodiment 13: A downhole seal tool including a seal assembly, and a releasable locking assembly as in any prior embodiment, attached to the seal assembly.

Embodiment 14: The releasable locking assembly as in any prior embodiment, wherein seal assembly is a packer.

Embodiment 15: The releasable locking assembly as in any prior embodiment, wherein packer is a solid body packer.

Embodiment 16: The releasable locking assembly as in any prior embodiment, wherein the solid body packer includes multiple flow bores therethrough.

Embodiment 17: A wellbore system including a borehole in a formation, a string in the borehole, and a releasable locking assembly as in any prior embodiment, disposed in the string.

Embodiment 18: A method for releasing a releasable locking assembly of a multiple flow bore body in a housing of a downhole tool including shifting the support member of the releasable locking assembly as in any prior embodiment, unsupporting the locking segment by the shifting of the support member, and allowing disengagement of the locking segment from the housing.

Embodiment 19: The method as in any prior embodiment, wherein the downhole tool further includes another locking segment having an outer convex surface of a first radius defined by distance from a first axis, and an inner concave surface of a second radius defined by distance from a second axis different than the first axis, the another locking segment disposed at least in part in another window radially defined through the body, and another support member disposed within the body and moveable between a position where the another support member drives the another locking segment into engagement with the housing and a position where the another support member unsupports the another locking segment with regard to engagement with the housing, the method further comprising, shifting the another support member, unsupporting the another locking segment by the shifting of the another support member, and allowing disengagement of the another locking segment from the housing.

Embodiment 20: The method as in any prior embodiment, wherein the shifting the support member and the shifting the another support member occurs in separate runs.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A releasable locking assembly comprising:

a housing;

a body defining a longitudinally extending flow bore having a first end and a second end disposed within the housing;

a window defined through a radial wall of the body;

a locking segment having an outer convex surface of a first radius defined by distance from a first axis, and an inner concave surface of a second radius defined by distance from a second axis different than the first axis, the locking segment disposed at least in part in the window; and a support member disposed within the body and moveable between a position where the support member drives the locking segment into engagement with the housing and a position where the support member unsupports the locking segment with regard to engagement with the housing.

2. The releasable locking assembly as claimed in claim 1 wherein the body defines a plurality of longitudinally extending flow bores therein.

3. The releasable locking assembly as claimed in claim 1 wherein the body is a single piece of material with a plurality of longitudinally extending flow bores formed therein.

4. The releasable locking assembly as claimed in claim 1 wherein the window includes a window ledge that reduces open dimensions of the window to less than external dimensions of the locking segment.

5. The releasable locking assembly as claimed in claim 1 wherein the window is defined in part by a chord through a curvature of the body.

6. The releasable locking assembly as claimed in claim 1 wherein the locking segment includes engagement enhancing features on the convex surface.

7. The releasable locking assembly as claimed in claim 6 wherein the features are V-grooves.

8. The releasable locking assembly as claimed in claim 1 wherein the support member is a sleeve.

9. The releasable locking assembly as claimed in claim 8 wherein the sleeve is shiftable upon release of a sleeve release member releasing.

10. The releasable locking assembly as claimed in claim 9 wherein the sleeve release member is a shear member.

11. A multiple flow bore body comprising a locking assembly for the body to lock the body in place within a radially outwardly located structure, the assembly disposed in a window through a radial wall of the body, the window intersecting one flow bore of the multiple flow bores and actuated from the same one of the multiple flows bores.

12. The multiple flow bore body as claimed in claim 11 further comprising a second locking assembly actuated from another of the multiple flow bores.

13. A downhole seal tool comprising:

a seal assembly; and a releasable locking assembly as claimed in claim 1 attached to the seal assembly.

14. The releasable locking assembly as claimed in claim 13 wherein seal assembly is a packer.

15. The releasable locking assembly as claimed in claim 14 wherein packer is a solid body packer.

16. The releasable locking assembly as claimed in claim 15 wherein the solid body packer includes multiple flow bores therethrough.

17. A wellbore system comprising:

a borehole in a formation;

a string in the borehole; and a releasable locking assembly as claimed in claim 1 disposed in the string.

18. A method for releasing a releasable locking assembly of a multiple flow bore body in a housing of a downhole tool comprising:

shifting the support member of the releasable locking assembly as claimed in claim 1;

unsupporting the locking segment by the shifting of the support member; and allowing disengagement of the locking segment from the housing.

19. The method as claimed in claim 18 wherein the downhole tool further includes another locking segment having an outer convex surface of a first radius defined by distance from a first axis, and an inner concave surface of a second radius defined by distance from a second axis different than the first axis, the another locking segment disposed at least in part in another window radially defined through the body; and another support member disposed within the body and moveable between a position where the another support member drives the another locking segment into engagement with the housing and a position where the another support member unsupports the another locking segment with regard to engagement with the housing, the method further comprising;

shifting the another support member;

unsupporting the another locking segment by the shifting of the another support member; and allowing disengagement of the another locking segment from the housing.

20. The method as claimed in claim 19 wherein the shifting the support member and the shifting the another support member occurs in separate runs.

* * * * *